US010053962B2

(12) United States Patent
Hailey, Jr.

(10) Patent No.: US 10,053,962 B2
(45) Date of Patent: Aug. 21, 2018

(54) PREPACKED SAND SCREEN ASSEMBLIES

(71) Applicant: Halliburton Energy Services, Inc., Houston, TX (US)

(72) Inventor: Travis Thomas Hailey, Jr., Sugar Land, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 333 days.

(21) Appl. No.: 14/778,654

(22) PCT Filed: Dec. 23, 2014

(86) PCT No.: PCT/US2014/072227
§ 371 (c)(1),
(2) Date: Sep. 21, 2015

(87) PCT Pub. No.: WO2016/105398
PCT Pub. Date: Jun. 30, 2016

(65) Prior Publication Data

US 2016/0326850 A1 Nov. 10, 2016

(51) Int. Cl.

| | |
|---|---|
| ***E21B 43/08*** | (2006.01) |
| ***E21B 43/04*** | (2006.01) |
| ***E21B 43/14*** | (2006.01) |
| ***E21B 33/12*** | (2006.01) |

(52) U.S. Cl.
CPC ..... *E21B 43/082* (2013.01); *E21B 33/12* (2013.01); *E21B 43/04* (2013.01); *E21B 43/14* (2013.01)

(58) Field of Classification Search
CPC ..... E21B 43/08; E21B 43/04; E21B 43/082
See application file for complete search history.

(56) References Cited

U.S. PATENT DOCUMENTS

| | | | | |
|---|---|---|---|---|
| 5,232,048 | A | 8/1993 | Whitebay et al. | |
| 5,829,522 | A * | 11/1998 | Ross | E21B 43/082 166/228 |
| 2010/0051270 | A1 | 3/2010 | Dusterhoft et al. | |
| 2012/0273196 | A1* | 11/2012 | Pei | E21B 43/08 166/276 |

OTHER PUBLICATIONS

International Search Report and Written Opinion for PCT/US2014/072227 dated Sep. 1, 2015.

* cited by examiner

*Primary Examiner* — Caroline N Butcher
(74) *Attorney, Agent, or Firm* — McDermott Will & Emery LLP

(57) ABSTRACT

A sand control screen assembly includes a base pipe defining one or more flow ports that provide fluid communication into an interior of the base pipe. A sand screen is arranged about an exterior of the base pipe and thereby defines a production annulus between the exterior of the base pipe and the sand screen. A prepack porous media is positioned in and fills the production annulus. A flow collector is positioned within at least one of the one or more flow ports and provides a retainer and a mass of porous media positioned within the retainer.

22 Claims, 2 Drawing Sheets

PREPACKED SAND SCREEN ASSEMBLIES

BACKGROUND

During hydrocarbon production from subsurface formations, efficient control of the movement of unconsolidated formation particles into the wellbore, such as sand or other debris, has always been a pressing concern. Such formation movement commonly occurs during production from completions in loose sandstone or following the hydraulic fracture of a subterranean formation. Formation movement can also occur suddenly in the event a section of the wellbore collapses, thereby circulating significant amounts of particulates and fines within the wellbore. Production of these unwanted materials may cause numerous problems in the efficient extraction of oil and gas from subterranean formations. For example, producing formation particles may tend to plug the formation, production tubing, and subsurface flow lines. Producing formation particles may also result in the erosion of casing, downhole equipment, and surface equipment. These problems lead to high maintenance costs and unacceptable well downtime.

Numerous methods have been utilized to control the production of these unconsolidated formation particles during production. Sand control screen assemblies, for instance, are used to regulate and restrict the influx of formation particles. Typical sand control screen assemblies are constructed by installing one or more screen jackets on a perforated base pipe. The screen jackets include one or more drainage layers, one or more screen elements such as a wire wrapped screen or single or multi-layer wire mesh screen, and a perforated outer shroud.

While sand screens offer a solution to preventing the influx of formation sand, over time the screen jackets and/or screen elements may erode. For instance, fluids drawn into the sand screens will tend to follow the path of least resistance, and in some cases, due to inherent fluid dynamics, the flow entering the screen will concentrate at one end of the sand screen. As can be appreciated, this can cause very high fluid velocities in the last few inches or feet of the sand screen. The dramatic increase in fluid velocity at the end of a sand screen may result in harmful erosion or deformation to the sand screen at that location, and such erosion or deformation may ultimately cause the sand screen to fail, thereby allowing formation or sand particulates to be produced with desired formation fluids (e.g., hydrocarbons).

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure generally relates to downhole fluid flow control and, more particularly, to sand control screen assemblies used to resist erosion and distribute fluid flow more evenly through sand screens.

The embodiments discussed herein provide sand control screen assemblies that include a prepack porous media positioned in and filling a production annulus defined between a base pipe and a sand screen. One or more flow collectors may be positioned within the flow ports defined in the base pipe and may each provide a retainer and a mass of porous media positioned within the retainer. The prepack porous media and the mass of porous media may comprise erosion-resistant materials that achieve a desired erosion resistance for the sand screen without the need for extremely expensive materials, such as large quantities of industrial ceramics or tungsten carbide. This may be accomplished by mitigating the fluid flow convergence/concentration on the sand screen by generating a pressure drop as the incoming fluids must pass through tortuous flow paths defined by each of the prepack porous media and the mass of porous media. As a result, erosion of the sand screen may be mitigated.

Figure 1:
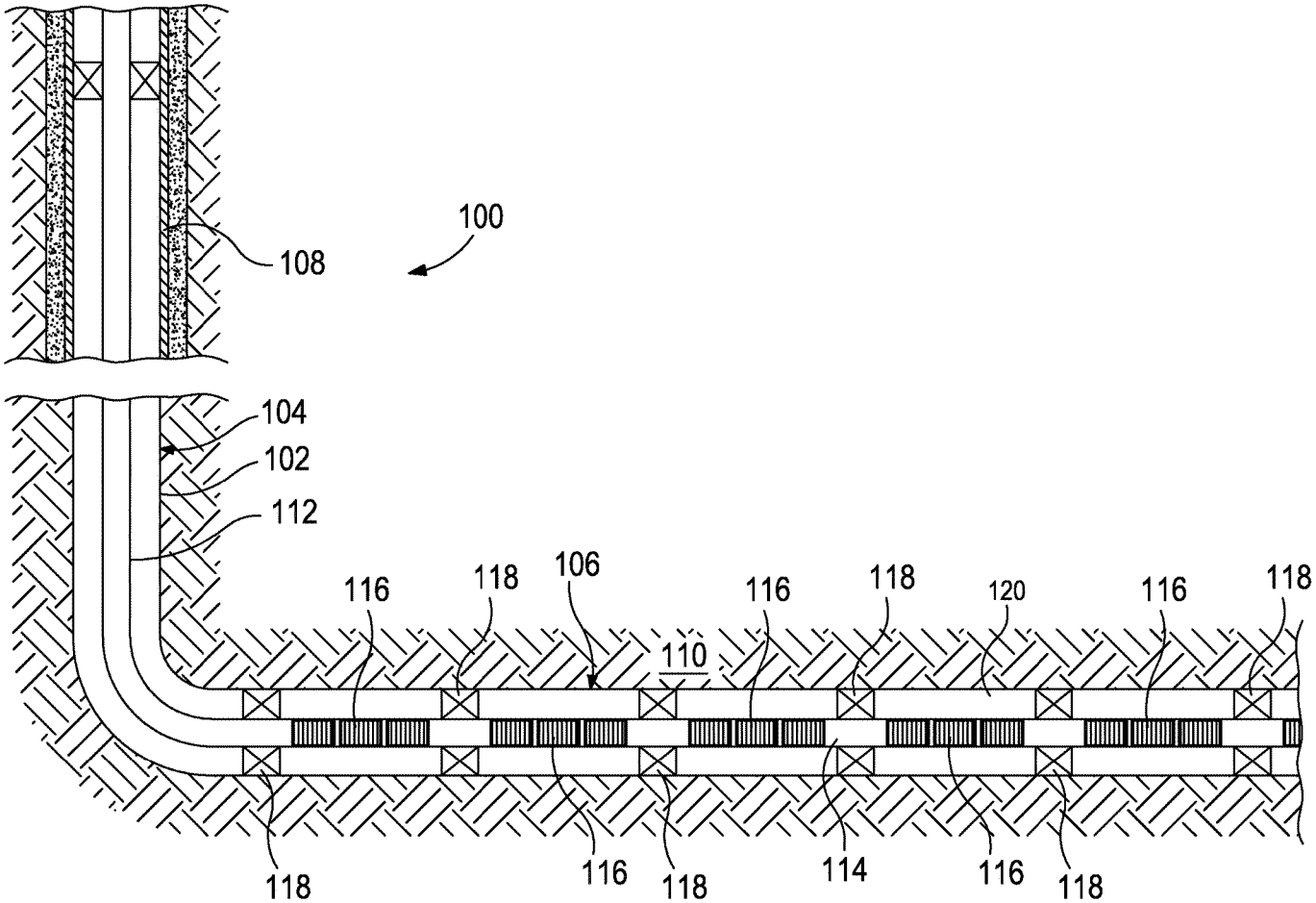
FIG. 1 is a schematic of a well system that may employ the principles of the present disclosure.

Referring to FIG. 1, illustrated is a well system 100 that may employ the principles of the present disclosure, according to one or more embodiments of the disclosure. As depicted, the well system 100 includes a wellbore 102 that extends through various earth strata and has a substantially vertical section 104 extending to a substantially horizontal section 106. The upper portion of the vertical section 104 may have a casing string 108 cemented therein, and the horizontal section 106 may extend through a hydrocarbon bearing subterranean formation 110. In at least one embodiment, the horizontal section 106 may be arranged within or otherwise extend through an open hole section of the wellbore 102.

A tubing string 112 may be positioned within the wellbore 102 and extend from the surface (not shown). In production operations, the tubing string 112 provides a conduit for fluids extracted from the formation 110 to travel to the surface. In injection operations, the tubing string 112 provides a conduit for fluids introduced into the wellbore 102 at the surface to be injected into the formation 110. At its lower end, the tubing string 112 may be coupled to a completion string 114 arranged within the horizontal section 106. The completion string 114 serves to divide the completion interval into various production intervals adjacent the formation 110. As depicted, the completion string 114 may include a plurality of sand control screen assemblies 116 axially offset from each other along portions of the completion string 114. Each sand control screen assembly 116 may be positioned between a pair of packers 118 that provides a fluid seal between the completion string 114 and the wellbore 102, thereby defining corresponding production intervals. In operation, the sand control screen assemblies 116 serve the primary function of filtering particulate matter out of the production fluid stream such that particulates and other fines are not produced to the surface.

In some embodiments, the annulus 120 defined between the sand control screen assemblies 116 and the wall of the wellbore 102, and in between adjacent packers 118, may be packed with gravel or "gravel-packed." In other embodiments, however, the annulus 120 may remain unpacked. In embodiments where the annulus 120 remains unpacked, a significant part of the flow from the formation 110 may tend to flow in the annulus 120 toward the upper end of each interval between the packers 118 and converge into the sand control screen assemblies 116 through only the last few inches or feet of the sand screen 116 of each said interval. Embodiments of the present disclosure, however, may mitigate this tendency, and thereby mitigate detrimental erosion effects that may occur with concentrated flow.

It should be noted that even though FIG. 1 depicts the sand control screen assemblies 116 as being arranged in an open hole portion of the wellbore 102, embodiments are contemplated herein where one or more of the sand control screen assemblies 116 is arranged within cased portions of the wellbore 102. Also, even though FIG. 1 depicts a single sand control screen assembly 116 arranged in each production interval, it will be appreciated by those skilled in the art that any number of screen assemblies 116 may be deployed within a given production interval without departing from the scope of the disclosure. In addition, even though FIG. 1 depicts multiple production intervals separated by the packers 118, it will be understood by those skilled in the art that the completion interval may include any number of production intervals with a corresponding number of packers 118 arranged therein. In other embodiments, the packers 118 may be entirely omitted from the completion interval, without departing from the scope of the disclosure.

While FIG. 1 depicts the screen assemblies 116 as being arranged in a generally horizontal section 106 of the wellbore 102, those skilled in the art will readily recognize that the screen assemblies 116 are equally well suited for use in wells having other directional configurations including vertical wells, deviated wellbores, slanted wells, multilateral wells, combinations thereof, and the like. The use of directional terms such as above, below, upper, lower, upward, downward, left, right, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Figure 2:
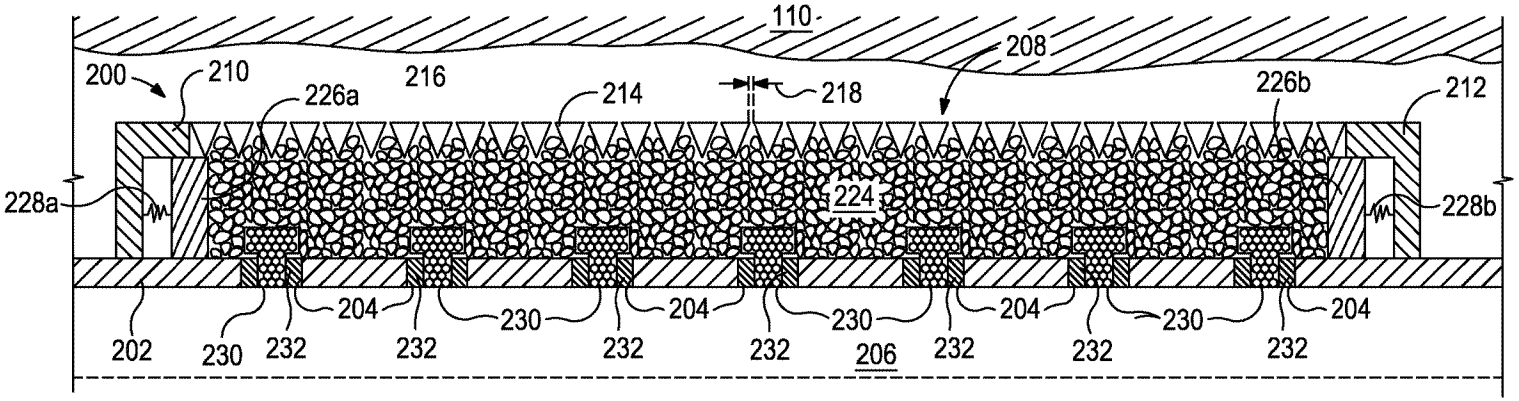
FIG. 2 is a cross-sectional side view of an exemplary sand control screen assembly.

Referring now to FIG. 2, with continued reference to FIG. 1, illustrated is a cross-sectional view of an exemplary sand control screen assembly 200, according to one or more embodiments. The sand control screen assembly 200 (hereafter "the screen assembly 200") may be the same as or similar to any of the sand control screen assemblies 116 of FIG. 1 and may therefore be used in the well system 100 depicted therein. The screen assembly 200 may include or otherwise be arranged about a base pipe 202 that defines one or more openings or flow ports 204 configured to provide fluid communication between an interior 206 of the base pipe 202 and the surrounding formation 110. The base pipe 202 may form part of or otherwise comprise the completion string 114 of FIG. 1.

The screen assembly 200 may further include a screen jacket 208 that is attached or otherwise coupled to the exterior of the base pipe 202. In operation, the screen jacket 208 and its various components may serve as a filter medium designed to allow fluids derived from the formation 110 to flow therethrough and simultaneously prevent the influx of particulate matter of a predetermined size. As illustrated, the screen jacket 208 may extend between an upper end ring 210 arranged about the base pipe 202 at an uphole end and a lower end ring 212 arranged about the base pipe 202 at a downhole end. The upper and lower end rings 210, 212 provide a mechanical interface between the base pipe 202 and the opposing ends of the screen jacket 208. Each end ring 210, 212 may be formed from a metal, such as 13 chrome stainless steel, 304L stainless steel, 316L stainless steel, 420 stainless steel, 410 stainless steel, INCOLOY® 825, iron, brass, copper, bronze, tungsten, titanium, cobalt, nickel, an alloy of the foregoing, or the like. Moreover, each end ring 210, 212 may be coupled or otherwise attached to the outer surface of the base pipe 202 by being welded, brazed, threaded, mechanically fastened, combinations thereof, or the like. In other embodiments, however, one or both of the end rings 210, 212 may be omitted or otherwise form an integral part of the screen jacket 208, and not a separate component thereof.

The screen jacket 208 may further include one or more sand screens 214 arranged about the base pipe 202. The sand screen 214 may be a fluid-permeable, particulate restricting device that allows fluids to flow therethrough but generally prevent the influx of particulate matter of a predetermined size and greater. In some embodiments, the sand screen 214 may be made from a plurality of layers of a wire mesh that are diffusion bonded or sintered together to form a fluid porous wire mesh screen. In other embodiments, however, the sand screen 214 may have multiple layers of a weave mesh wire material having a uniform pore structure and a controlled pore size that is determined based upon the properties of the formation 110. For example, suitable weave mesh screens may include, but are not limited to, a plain Dutch weave, a twilled Dutch weave, a reverse Dutch weave, combinations thereof, or the like. In other embodiments, however, the sand screen 214 may include a single layer of wire mesh, multiple layers of wire mesh that are not bonded together, a single layer of wire wrap, multiple layers of wire wrap or the like, that may or may not operate with a drainage layer. Those skilled in the art will readily recognize that several other mesh designs are equally suitable, without departing from the scope of the disclosure.

In some embodiments, the materials of the sand screen 214 may be surface hardened, such as being subjected to one or more surface-hardening processes. Suitable surface-hardening processes include, but are not limited to, nitriding, plasma coating, heat-treating, any combination thereof, and the like. In yet other embodiments, the sand screen 214 may alternatively be made of an erosion-resistant material, such as ceramic.

As illustrated, the sand screen 214 may be radially offset a short distance from the base pipe 202 and thereby define a production annulus 224 therebetween. The sand screen 214 may also be coupled or otherwise attached to the upper end ring 210 at its uphole end, and coupled or otherwise attached to the lower end ring 212 at its downhole end. In one or more embodiments, however, one or both of the upper and lower end rings 210, 212 may be omitted from the screen assembly 200 and the sand screen 214 may alternatively be coupled directly to the base pipe 202 at its uphole and/or downhole ends, without departing from the scope of the disclosure.

The screen assembly 200 may also include a prepack porous media 216 positioned in and otherwise filling the production annulus 224 between the base pipe 202 and the sand screen 214. The prepack porous media 216 may comprise particulates of an erosion-resistant material packed into the production annulus 224. The erosion-resistant material may include any material that resists erosion from fluid flow or from particulates and fines that may be derived from the formation 110 during production operations. Suitable erosion-resistant materials for the prepack porous media 216 include, but are not limited to, sintered bauxite, ceramic beads, a high-strength proppant, a fine sintered wire mesh, sintered metal pieces or pellets, pellets or pieces of metal carbide (e.g., silicon carbide, tungsten carbide, etc.), and pellets or beads coated with any of the above-identified materials, a diamond coating, or a resin coating.

The particulates of the erosion-resistant material may exhibit any cross-sectional shape suitable to be packed within the production annulus 224. For instance, the particulates of the erosion-resistant material may exhibit a cross-sectional shape that is spherical or polygonal, without departing from the scope of the disclosure. The size (e.g., diameter) of the particulates may be a function of the particle size that the prepack porous media 216 is intended to filter, which is generally dictated by the particle size from the formation 110. In some embodiments, the size (e.g., diameter) of the particulates of the erosion-resistant material used in the prepack porous media 216 may be the same as or larger than a gap 218 between adjacent wires of the sand screen 214. As a result, the erosion-resistant material may be prevented from escaping the production annulus 224 via the sand screen 214. Example sizes (e.g., diameter) of the particulates of the erosion-resistant material used in the prepack porous media 216 include, but are not limited to, 30/50 mesh, 40/60 mesh, and 20/40 mesh, which constitute sizes of commonly sold high strength proppants.

In some embodiments, the prepack porous media 216 may be maintained as a generally fluidic mass or slurry of loose or semi-loose erosion-resistant material disposed within the production annulus 224. As used herein, the term "fluidic mass," as used in conjunction with the prepack porous media 216, refers to the prepack porous media 216 being able to act as a fluid. In order to retain the fluidic mass of erosion-resistant material within the production annulus 224, the screen assembly 200 may further include one or more stress blocks 226, shown as a first stress block 226*a* and a second stress block 226*b*. The stress blocks 226*a,b* may each comprise a plate positioned at opposing ends of the screen assembly 200 within the production annulus 224. In some embodiments, as illustrated, the stress blocks 226*a,b* may be biased against the prepack porous media 216 using one or more biasing devices 228, shown as a first biasing device 228*a* that interposes the upper end ring 210 and the first stress block 226*a* and a second biasing device 228*b* that interposes the lower end ring 212 and the second stress block 226*b*. The biasing devices 228*a,b* may comprise any type of device or mechanism capable of biasing the first and second stress blocks 226*a,b* against the prepack porous media 216. Suitable biasing devices 228*a,b* include, but are not limited to, a compression spring, a series of Belleville washers, a hydraulic actuator, a pneumatic actuator, any combination thereof, or the like. In operation, the stress blocks 226*a,b* may be used to maintain the prepack porous media 216 tightly packed within the production annulus 224, including during vibration induced by production operations, while running the screen assembly 200 into the wellbore 102 (FIG. 1), and during thermal expansion of metal components of the screen assembly 200 due to running the screen assembly 200 into the wellbore 102. Accordingly, the stress blocks 226*a,b* may continuously or intermittently operate to remove voids within the prepack porous media 216, and thereby maintain the prepack porous media 216 void-free.

While two stress blocks 226*a,b* are depicted in FIG. 2 at each end of the production annulus 224, it will be appreciated that the screen assembly 200 may alternatively employ only a single stress block 226, without departing from the scope of the disclosure. Moreover, in some embodiments, the stress blocks 226*a,b* may be omitted altogether from the screen assembly 200, such as in embodiments where manufacturing techniques ensure a completely and tightly packed prepack porous media 216.

In other embodiments, however, the prepack porous media 216 may comprise a consolidated mass, thereby also removing the need for the stress blocks 226*a,b*. As used herein, the term "consolidated mass," as used in conjunction with the prepack porous media 216, refers to the prepack porous media 216 being able to act as a solid, such as a permeable or semi-permeable, solid structure. In such embodiments, the prepack porous media 216 may be manufactured such that the erosion-resistant material is formed or otherwise fashioned into a solidified or hardened structure that exhibits a predetermined shape or configuration, such as the shape of the production annulus 224. In other embodiments, the erosion-resistant material may be deposited into the production annulus 224 as a slurry or fluidic mixture and subsequently solidified or hardened to form the consolidated mass. The slurry of erosion-resistant material may be agglomerated or otherwise bound together using one or more binding agents, adhesives, epoxies, through heated diffusion bonding of the erosion-resistant material, or through other manufacturing techniques known to those skilled in the art.

In some embodiments, the screen assembly 200 may further include one or more flow collectors 230 positioned within a corresponding one or more of the flow ports 204 defined in the base pipe 202. In the illustrated embodiment, flow collectors 230 are depicted as being positioned within each flow port 204, but may alternatively be positioned only in one or more selected flow ports 204, without departing from the scope of the disclosure. The flow collectors 230 may be distributed over the length of the screen assembly 200 and about the circumference of the base pipe 202, and thereby promote uniform fluid flow distribution through the sand screen 214 from the formation 110. Providing a uniform flow distribution may prove advantageous in reducing the maximum fluid flow velocity at any one point along the sand screen 214 and thereby mitigating the risk of erosion. Moreover, as described in more detail below, the presence of the prepack porous media 216 in the production annulus 224 may further promote such uniform fluid flow distribution, owing to a pressure drop experienced by the fluid flowing through the prepack porous media 216, in accordance with Darcy's law.

Each flow collector 230 may be coupled to the base pipe 202 at a corresponding flow port 204. In some embodiments, the flow collector 230 may be coupled directly to the base pipe 202 at the corresponding flow port 204. In such embodiments, the flow collectors 230 may be coupled to the base pipe 202 via a variety of means such as, but not limited to, threading, welding, brazing, shrink fitting, using one or more mechanical fasteners (e.g., screws, bolts, pins, snap rings, etc.), using an industrial adhesive, and any combination thereof. In other embodiments, however, the flow collectors 230 may be coupled to the base pipe 202 via a corresponding bushing 232 secured within the flow ports 104. More particularly, the bushing 232 may be secured within the flow port 204 using one or more of the afore-mentioned means, and the flow collector 230 may then, in turn, be secured within the bushing 232 also via one or more of the afore-mentioned means.

The bushing 232 may be made of a variety of rigid but suitably ductile materials that may or may not be erosion-resistant. Suitable materials for the bushing 232 include, but are not limited to, a metal (e.g., steel, titanium, nickel alloys, etc.), a carbide (e.g., tungsten, titanium, tantalum, or vanadium), a carbide embedded in a matrix of cobalt or nickel by sintering, a cobalt alloy, a ceramic, a surface hardened metal (e.g., nitrided metals, heat-treated metals, carburized metals, hardened steel, etc.), or any combination thereof. In other embodiments, or in addition thereto, the bushing 232 may be clad or coated with an erosion-resistant material, such as tungsten carbide, a cobalt alloy, or ceramic.

Figure 3B:
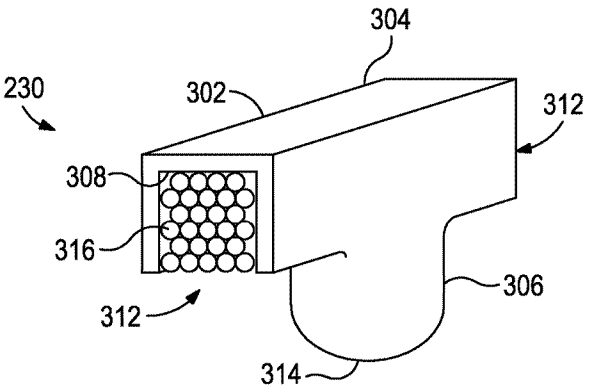
FIGS. 3A and 3B are partial cross-sectional side and isometric views, respectively, of an exemplary flow collector.
Figure 3A:
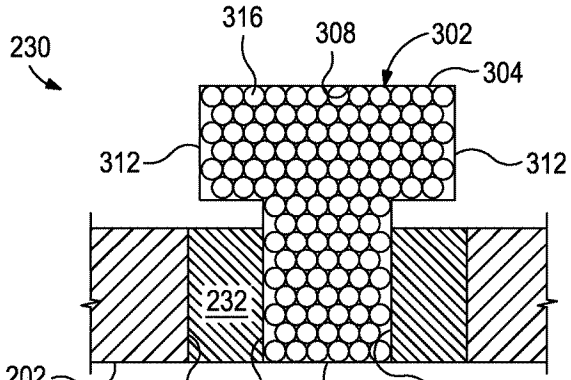

Referring now to FIGS. 3A and 3B, with continued reference to FIG. 2, illustrated are partial cross-sectional side and isometric views, respectively, of an exemplary flow collector 230, according to one or more embodiments. As illustrated, the flow collector 230 may include a body or retainer 302 that provides or otherwise defines a head 304 and a stem 306 that extends radially from the head 304. In the illustrated embodiment, the head 304 is depicted as exhibiting a generally polygonal cross-sectional shape and defining an inner flow path 308. The stem 306 is depicted as exhibiting a generally circular shape and may also define an inner flow path 310, where the inner flow paths 308, 310 fluidly communicate with one another. In other embodiments, however, the head 304 and the stem 306 may alternatively exhibit any cross-sectional shape suitable for use in the screen assembly 200 (FIG. 2), without departing from the scope of the disclosure.

In some embodiments, as illustrated, the head 304 may be generally formed as an elongate polygonal cylinder, thereby rendering the retainer 302 as a generally T-shaped structure. The head 304 may define and otherwise provide one or more inlets 312 configured to allow a fluid to access the inner flow paths 308, 310 from the production annulus 224 (FIG. 2). In the illustrated embodiment, the retainer 302 is depicted as providing two inlets 312 defined at opposing axial ends of the head 304. In other embodiments, however, the retainer 302 may alternatively provide only one inlet 312, or more than two inlets 312, without departing from the scope of the disclosure. As will be appreciated by those skilled in the art, the generally T-shaped retainer 302 having inlets 312 at each end may prove advantageous in providing two fluid inflow points into the retainer 302 to distribute the flow of fluids into the flow collector 230. The T-shaped retainer 302 may also prove advantageous in being able to be positioned longitudinally between longitudinally extending ribs (not shown) used to radially support the sand screen 214 (FIG. 2) within the production annulus 224.

The stem 306 may be shaped and otherwise configured to fit into a corresponding bushing 232, which may be secured within a corresponding flow port 104 of the base pipe 202 (FIG. 2). In other embodiments, however, the bushing 232 may be omitted and the stem 306 may alternatively be shaped and otherwise configured to fit into a corresponding flow port 104, as mentioned above. The stem 306 may define and otherwise provide an outlet 314 in fluid communication with the inlet(s) 312 via the inner flow paths 308, 310. The outlet 314 may be in fluid communication with the interior 206 (FIG. 2) of the base pipe 202 such that a fluid is able to access the interior 206 from the production annulus 224 (FIG. 2) by passing or flowing through the flow collector 230.

The retainer 302 may be made of a variety of rigid materials that may or may not be erosion-resistant. Suitable materials for the retainer 302 include, but are not limited to, a metal (e.g., steel, titanium, nickel alloy, etc.), a carbide (e.g., tungsten, titanium, tantalum, or vanadium), a carbide embedded in a matrix of cobalt or nickel by sintering, a cobalt alloy, a ceramic, a surface hardened metal (e.g., nitrided metals, heat-treated metals, carburized metals, hardened steel, etc.), or any combination thereof. In other embodiments, or in addition thereto, various surfaces of the retainer 302, such as the inner flow paths 308, 310, may be clad or coated with an erosion-resistant material, such as tungsten carbide, a cobalt alloy, or ceramic.

The retainer 302 may include and otherwise house a mass of porous media 316 positioned within the interior of the retainer 302 and otherwise within all or a portion of the inner flow paths 308, 310. Similar to the prepack porous media 216 of FIG. 2, the mass of porous media 316 may comprise particulates or particles of any erosion-resistant material that resists erosion from particulates and fines that may be derived from the formation 110. Suitable erosion-resistant materials for the mass of porous media 316 include, but are not limited to, sintered bauxite, ceramic beads, fused or non-fused metal beads, a high-strength proppant, a fine sintered or non-sintered wire mesh, sintered or non-sintered metal pieces or pellets, pellets or pieces of metal carbide (e.g., silicon carbide, tungsten carbide, etc.), and pellets or beads coated with any of the above-identified materials, a diamond coating, or a resin coating.

The mass of porous media 316 may be maintained as a consolidated mass secured within the interior of the retainer 302. In some embodiments, the mass of porous media 316 may be manufactured such that the material is formed or otherwise fashioned into a solidified or hardened structure that exhibits a predetermined shape or configuration, such as the internal shape of the retainer 302. In other embodiments, the material for the mass of porous media 316 may be deposited into the retainer 302 as a slurry or fluidic mixture and subsequently solidified or hardened to form the consolidated mass. The slurry of material for the mass of porous media 316 may be agglomerated or otherwise bound together using one or more binding agents, adhesives, epoxies, through heated diffusion bonding of the material, or through other manufacturing techniques known to those skilled in the art.

In other embodiments, however, the mass of porous media 316 may at least partially comprise a fluidic mass. In such embodiments, portions of the mass of porous media 316 located at or near the inlet(s) 312 and the outlet 314 of the retainer 302 may be consolidated to retain the entirety of the mass of porous media 316 within the interior of the retainer 302. Alternatively, the mass of porous media 316 may entirely comprise a fluidic mass and, in such embodiments, a screen, sieve, or other retaining mechanism may be positioned at the inlet(s) 312 and the outlet 314 of the retainer 302 to retain the unconsolidated mass of porous media 316 within the interior of the retainer 302, while simultaneously allowing fluid flow through the flow collector 230.

The individual particles or "beads" of the mass of porous media 316 may exhibit a predetermined size or diameter. For instance, in some embodiments, the diameter of the beads of the mass of porous media 316 may be the same as or larger than the diameter of the particles comprising the prepack porous media 216 (FIG. 2). As will be appreciated, this may prove advantageous in preventing small particles from the formation 110 (FIG. 2) passing through the prepack porous media 216 from becoming trapped in the flow collector 230, while simultaneously preventing larger particles that may have passed through the prepack porous media 216 from infiltrating the flow collector 230.

Referring again to FIG. 2, with continued reference to FIGS. 3A and 3B, exemplary operation of the screen assembly 200 is now provided. The screen assembly 200 may be configured to draw in fluids from the surrounding formation 110 via the sand screen 214. Solid particulates, fines, and/or debris larger than the gap 218 may be prevented from passing through the sand screen 214. The fluid may flow into the production annulus 224 where it will be required to traverse the prepack porous media 216, which may provide a tortuous flow path for the fluid to traverse. As a result, solid particulates, fines, and/or debris that pass into the prepack porous media 216 may undergo a second filtering process. The fluid may eventually proceed through the prepack porous media 216 until encountering the flow collectors 230 and the mass of porous media 316 disposed within the retainer 302 of each flow collector 230. The mass of porous media 316 may also require the fluid to traverse a tortuous flow path before eventually entering the interior 206 of the base pipe 202 at the one or more flow ports 204. As a result, solid particulates, fines, and/or debris that pass into the flow collectors 230 may undergo a third filtering process. The fluid may eventually flow into the interior 206 of the base pipe 202 via the flow collectors 230 for production to the surface.

Accordingly, the prepack porous media 216 and the mass of porous media 316 may serve as redundant filters of solid particulates, fines, and/or debris originating from the formation 110. As will be appreciated, such redundant filtering capabilities may prove advantageous in the event the sand screen 214 is damaged or otherwise eroded. As a result, the screen assembly 200 may provide to the surface a continuous and uninterrupted flow of fluids from the formation 110, even in the event the sand screen 214 is damaged. The prepack porous media 216 and the mass of porous media 316 may also serve as depth filters, while still allowing fluid flow therethrough. However, if a breach in the sand screen 214 is significant, the prepack porous media 216 and the mass of porous media 316 may further prove advantageous in plugging off and essentially sealing the screen assembly 200 such that damaging debris is not produced to the surface.

Another advantage that the screen assembly 200 may provide is the introduction of a known pressure drop for fluids passing through the sand screen 214, which may help mitigate possible erosion of the sand screen 214. More particularly, the screen assembly 200 provides limited, but well distributed flow points, along the base pipe 202 at the multiple flow collectors 230, which may serve to uniformly distribute the flow through the sand screen 214 and prevent movement of the prepack porous media 216 within the production annulus 224. The pressure drop over the screen assembly 200 may be generally determined based on several parameters, including the type of fluid that is flowing from the formation 110, how fast the fluid is flowing, and the permeability of the prepack porous media 216 and the mass of porous media 316. Testing may be required to establish exact pressure drops for various fluids and configurations of the screen assembly 200, but generally the pressure response may be fairly well estimated via Darcy flow relationships.

In some cases, the pressure drops may be calculated using computational fluid dynamics analysis to optimize operation of the screen assembly 200. In such cases, a desired pressure drop may be determined and engineered into the screen assembly 200 to sufficiently reduce the flow velocity of the fluid from the formation 110 at any given entry point into the sand screen 200 below a predetermined erosion flow rate threshold. In some embodiments, for instance, the flow collectors 230 may be evenly distributed along the base pipe 202 to provide a constant pressure drop along the base pipe 202 and an evenly distributed inflow of the fluid. In other embodiments, the size, density, and/or pattern of the flow collectors 230 may alternatively be varied along the base pipe 202 in a predetermined manner to provide a controlled variation of pressure drop and/or flow rate of the incoming fluid.

Embodiments disclosed herein include:

A. A sand control screen assembly that includes a base pipe defining one or more flow ports that provide fluid communication into an interior of the base pipe, a sand screen arranged about an exterior of the base pipe and thereby defining a production annulus between the exterior of the base pipe and the sand screen, a prepack porous media positioned in and filling the production annulus, and a flow collector positioned within at least one of the one or more flow ports, the flow collector providing a retainer and a mass of porous media positioned within the retainer.

B. A method that includes drawing a fluid through a sand screen arranged about a base pipe that defines one or more flow ports providing fluid communication into an interior of the base pipe, wherein a production annulus is between the exterior of the base pipe and the sand screen, flowing the fluid through a prepack porous media positioned in and filling the production annulus, and flowing the fluid through a flow collector positioned within at least one of the one or more flow ports, the flow collector providing a retainer and a mass of porous media positioned within the retainer.

Each of embodiments A and B may have one or more of the following additional elements in any combination: Element 1: wherein the sand screen is surface hardened by at least one of nitriding, plasma coating, heat-treating, and any combination thereof. Element 2: wherein the sand screen is at least partially made of ceramic. Element 3: wherein the prepack porous media comprises a first erosion-resistant material, and the mass of porous media comprises a second erosion-resistant material. Element 4: wherein the first and second erosion-resistant materials are materials selected from the group consisting of sintered bauxite, ceramic beads, fused metal beads, a high-strength proppant, a fine sintered wire mesh, sintered metal pieces or pellets, pellets or pieces of metal carbide, and pellets or beads coated with any of the above-identified materials, a diamond coating, or a resin coating. Element 5: wherein the prepack porous media comprises erosion-resistant particulates that exhibit a diameter greater than or equal to a gap between adjacent wires of the sand screen. Element 6: wherein the mass of porous media comprises erosion-resistant beads that exhibit a diameter greater than or equal to the diameter of the erosion-resistant particulates of the prepack porous media. Element 7: wherein the prepack porous media is a fluidic mass, the sand control screen assembly further comprises an end ring arranged about the base pipe and being coupled to one end of the sand screen, and a stress block positioned within the production annulus and biased against the prepack porous media with one or more biasing devices interposing the end ring and the stress block. Element 8: wherein the prepack porous media comprises a consolidated mass. Element 9: wherein the flow collector is secured within a bushing coupled to the base pipe at the at least one of the one or more flow ports. Element 10: wherein the bushing comprises a material selected from the group consisting of a metal, a carbide, a carbide embedded in a matrix of cobalt or nickel by sintering, a cobalt alloy, a ceramic, a surface hardened metal, and any combination thereof. Element 11: wherein the retainer comprises a material selected from the group consisting of a metal, a carbide, a carbide embedded in a matrix of cobalt or nickel by sintering, a cobalt alloy, a nickel alloy, a ceramic, a surface hardened metal, and any combination thereof. Element 12: wherein one or more surfaces of the retainer are clad with at least one of tungsten carbide, a cobalt alloy, and ceramic. Element 13: wherein the retainer further comprises a head that defines a first inner flow path and one or more inlets that allow a fluid to access the first inner flow path from the production annulus, and a stem that extends radially from the head and defines a second inner flow path in fluid communication with the first inner flow path, the stem further defining an outlet facilitating fluid communication between the production annulus and the interior of the base pipe via the first and second flow paths.

Element 14: wherein the prepack porous media comprises a first erosion-resistant material, and the mass of porous media comprises a second erosion-resistant material, and wherein the first and second erosion-resistant materials are materials selected from the group consisting of sintered bauxite, ceramic beads, fused metal beads, a high-strength proppant, a fine sintered wire mesh, sintered metal pieces or pellets, pellets or pieces of metal carbide, and pellets or beads coated with any of the above-identified materials, a diamond coating, or a resin coating. Element 15: wherein the prepack porous media is a fluidic mass, the method further comprising biasing a stress block positioned within the production annulus against the prepack porous media, wherein an end ring is arranged about the base pipe and coupled to one end of the sand screen, and the stress block is biased against the prepack porous media with one or more biasing devices interposing the end ring and the stress block, and maintaining the prepack porous media tightly packed within the production annulus with the stress block. Element 16: wherein the retainer includes a head that defines a first inner flow path and a stem that extends radially from the head and defines a second inner flow path in fluid communication with the first inner flow path, and wherein flowing the fluid through the flow collector comprises drawing the fluid into the first inner flow path from the production annulus via one or more inlets defined in the head, flowing the fluid through the second inner flow path, and discharging the fluid into the interior of the base pipe via an outlet defined by the stem. Element 17: wherein flowing the fluid through the prepack porous media comprises traversing a tortuous flow path defined by the prepack porous media and thereby filtering the fluid. Element 18: wherein flowing the fluid through the flow collector comprises traversing a tortuous flow path defined by the mass of porous media and thereby filtering the fluid. Element 19: further comprising generating a pressure drop across the sand screen by requiring the fluid to pass through the prepack porous media and the mass of porous media. Element 20: further comprising generating a pressure drop across the sand screen by spacing a plurality of flow collectors along the base pipe, each flow collector providing the retainer and the mass of porous media positioned within the retainer.

By way of non-limiting example, exemplary combinations applicable to A, B, and C include: Element 3 with Element 4; Element 5 with Element 6; and Element 9 with Element 10.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A sand control screen assembly, comprising:

a base pipe defining one or more flow ports that provide fluid communication into an interior of the base pipe;

a sand screen arranged about an exterior of the base pipe and thereby defining a production annulus between the exterior of the base pipe and the sand screen;

a prepack porous media positioned in and filling the production annulus; and a flow collector positioned within at least one of the one or more flow ports, the flow collector providing:

a retainer defining a head of the flow collector, the head having at least one inlet defined at an axial end thereof, wherein the retainer restricts entry of fluid into the flow collector from the production annulus to be through the axial end; and a mass of porous media positioned within the retainer, wherein the flow collector is configured to generate a pressure drop across the sand screen by requiring the fluid to pass through the prepack porous media and the mass of porous media.

2. The sand control screen assembly of claim 1, wherein the sand screen is surface hardened by at least one of nitriding, plasma coating, heat-treating, and any combination thereof.

3. The sand control screen assembly of claim 1, wherein the sand screen is at least partially made of ceramic.

4. The sand control screen assembly of claim 1, wherein the prepack porous media comprises a first erosion-resistant material, and the mass of porous media comprises a second erosion-resistant material.

5. The sand control screen assembly of claim 4, wherein the first and second erosion-resistant materials are materials selected from the group consisting of sintered bauxite, ceramic beads, fused metal beads, a high-strength proppant, a fine sintered wire mesh, sintered metal pieces or pellets, pellets or pieces of metal carbide, and pellets or beads coated with any of the above-identified materials, a diamond coating, or a resin coating.

6. The sand control screen assembly of claim 1, wherein the sand screen comprises a plurality of wires, and the prepack porous media comprises erosion-resistant particulates that exhibit a diameter greater than or equal to a gap between adjacent wires of the sand screen.

7. The sand control screen assembly of claim 6, wherein the mass of porous media comprises erosion-resistant beads that exhibit a diameter greater than or equal to the diameter of the erosion-resistant particulates of the prepack porous media.

8. The sand control screen assembly of claim 1, wherein the prepack porous media is a fluidic mass, the sand control screen assembly further comprises:

an end ring arranged about the base pipe and being coupled to one end of the sand screen; and a stress block positioned within the production annulus and biased against the prepack porous media with one or more biasing devices interposing the end ring and the stress block.

9. The sand control screen assembly of claim 1, wherein the prepack porous media comprises a consolidated mass.

10. The sand control screen assembly of claim 1, wherein the flow collector is secured within a bushing coupled to the base pipe at the at least one of the one or more flow ports.

11. The sand control screen assembly of claim 10, wherein the bushing comprises a material selected from the group consisting of a metal, a carbide, a carbide embedded in a matrix of cobalt or nickel by sintering, a cobalt alloy, a ceramic, a surface hardened metal, and any combination thereof.

12. The sand control screen assembly of claim 1, wherein the retainer comprises a material selected from the group consisting of a metal, a carbide, a carbide embedded in a matrix of cobalt or nickel by sintering, a cobalt alloy, a nickel alloy, a ceramic, a surface hardened metal, and any combination thereof.

13. The sand control screen assembly of claim 1, wherein one or more surfaces of the retainer are clad with at least one of tungsten carbide, a cobalt alloy, and ceramic.

14. The sand control screen assembly of claim 1, wherein the retainer further comprises:

a first inner flow path defined by the head, wherein the first inner flow path and the at least one inlet allows the fluid to access the first inner flow path from the production annulus; and a stem that extends radially from the head and defines a second inner flow path in fluid communication with the first inner flow path, the stem further defining an outlet facilitating fluid communication between the production annulus and the interior of the base pipe via the first and second flow paths.

15. The sand control screen assembly of claim 1, wherein the head extends longitudinally, and the axial end is defined at an end of a longitudinal axis of the head.

16. A method, comprising:

drawing a fluid through a sand screen arranged about a base pipe that defines one or more flow ports providing fluid communication into an interior of the base pipe, wherein a production annulus is between the exterior of the base pipe and the sand screen;

flowing the fluid through a prepack porous media positioned in and filling the production annulus;

flowing the fluid through a flow collector positioned within at least one of the one or more flow ports, the flow collector providing:

a retainer defining a head of the flow collector, the head having at least one inlet defined at an axial end thereof, wherein the retainer restricts entry of fluid into the flow collector from the production annulus to be through the axial end; and a mass of porous media positioned within the retainer; and generating a pressure drop across the sand screen by requiring the fluid to pass through the prepack porous media and the mass of porous media.

17. The method of claim 16, wherein the prepack porous media comprises a first erosion-resistant material, and the mass of porous media comprises a second erosion-resistant material, and wherein the first and second erosion-resistant materials are materials selected from the group consisting of sintered bauxite, ceramic beads, fused metal beads, a high-strength proppant, a fine sintered wire mesh, sintered metal pieces or pellets, pellets or pieces of metal carbide, and pellets or beads coated with any of the above-identified materials, a diamond coating, or a resin coating.

18. The method of claim 16, wherein the prepack porous media is a fluidic mass, the method further comprising:

biasing a stress block positioned within the production annulus against the prepack porous media, wherein an end ring is arranged about the base pipe and coupled to one end of the sand screen, and the stress block is biased against the prepack porous media with one or more biasing devices interposing the end ring and the stress block; and maintaining the prepack porous media tightly packed within the production annulus with the stress block.

19. The method of claim 16, wherein the head defines a first inner flow path and a stem that extends radially from the head and defines a second inner flow path in fluid communication with the first inner flow path, and wherein flowing the fluid through the flow collector comprises:

drawing the fluid into the first inner flow path from the production annulus via the at least one inlet defined in the head;

flowing the fluid through the second inner flow path; and discharging the fluid into the interior of the base pipe via an outlet defined by the stem.

20. The method of claim 16, wherein flowing the fluid through the prepack porous media comprises traversing a tortuous flow path defined by the prepack porous media and thereby filtering the fluid.

21. The method of claim 16, wherein flowing the fluid through the flow collector comprises traversing a tortuous flow path defined by the mass of porous media and thereby filtering the fluid.

22. The method of claim 16, further comprising generating a pressure drop across the sand screen by spacing a plurality of flow collectors along the base pipe, each flow collector providing the retainer and the mass of porous media positioned within the retainer.

* * * * *